United States Patent [19]

Kish

[11] Patent Number: 4,496,378

[45] Date of Patent: Jan. 29, 1985

[54] ACCUMULATOR DEHYDRATOR

[75] Inventor: Arthur S. Kish, Lyndhurst, Ohio

[73] Assignee: Murray Corporation, Cockeysville, Md.

[21] Appl. No.: 432,257

[22] Filed: Dec. 16, 1982

[51] Int. Cl.[3] ..... B01D 50/00; F25B 43/00

[52] U.S. Cl. ..... 55/316; 55/391; 55/465; 62/503

[58] Field of Search ..... 55/316, 320, 387, 391, 55/418, 462, 464, 465; 210/DIG. 6; 62/323.1, 503, 512

[56] References Cited

U.S. PATENT DOCUMENTS

| | | | |
|---|---|---|---|
| 934,679 | 9/1909 | Lea | 55/462 |
| 3,030,754 | 4/1962 | Root et al. | 55/320 |
| 3,296,777 | 1/1967 | Jackson et al. | 55/462 |
| 3,477,208 | 11/1969 | Keller, Sr. | 55/320 |
| 3,618,297 | 11/1971 | Hamrick | 55/320 |
| 4,214,883 | 7/1980 | Raseley et al. | 55/465 |
| 4,270,934 | 6/1981 | Widdowson et al. | 55/316 |
| 4,291,548 | 9/1981 | Livesay | 210/DIG. 6 |

*Primary Examiner*—David L. Lacey

*Attorney, Agent, or Firm*—Irvin A. Lavine

[57] ABSTRACT

An accumulator dehydrator is disclosed having a deflector for directing the flow of refrigerant into the dehydrator, said deflector formed of sheet metal, and permanently secured in operative position by component parts of the accumulator dehydrator. The deflector is provided with a planar body portion which is disposed at an angle to the flow of the incoming refrigerant, and is provided with flanges which inhibit lateral flow of the refrigerant. The deflector is also provided with a portion of arcuate configuration, which is clamped to the accumulator dehydrator in a manner which prevents movement in any direction relatively to the accumulator dehydrator.

6 Claims, 11 Drawing Figures

ACCUMULATOR DEHYDRATOR

This invention as indicated relates to accumulator dehydrators, and more particular to accumulator dehydrators for use in air conditioning refrigeration systems and the like.

BACKGROUND OF THE INVENTION

In an automotive air-conditioning system, the compressor pumps heat-laden refrigerant from the evaporator, and compresses the refrigerant, sending it, under high pressure, to the condenser as a superheated vapor. Since the high pressure vapor delivered to the condensor is much hotter than the surrounding air, it gives up its heat to the outside air flowing through the condenser fins.

As the refrigerant vapor gives up its heat, it changes to a liquid. The condensed liquid refrigerant is filtered, dried and temporarily stored under pressure, in the receiver-drier, also known as the "accumulator dehydrator", until it is needed by the evaporator.

Liquid refrigerant is metered from the condenser into the evaporator by an orifice tube which controls the flow of refrigerant in the conditioning system. The orifice tube floods the evaporator with liquid refrigerant. In so doing, the liquid refrigerant picks up heat from the warm air passing through the fins of the evaporator. The warm liquid refrigerant boils into the accumulator dehydrator. The compressor then transmitts the warm dehydrated vapor to the condensor for dissipation.

The present invention is concerned particularly with the accumulator dehydrator or receiver-drier, which, as stated, is a part of the system that is used to store refrigerant. It is located in the low-pressure side of the air-conditioning system and for the most part, contains liquid refrigerant.

The accumulator dehydrator usually consists of a cylindrical metal can with inlet and outlet fittings and, in most cases a a sight glass. It may be divided into two parts: the receiver and the drier.

The accumulator section of the tank or can is a storage compartment to accept the proper amount of excess refrigerant the system requires to insure operation. It is function of the accumulator section to insure that a steady flow of vapor refrigerant is supplied to the compressor.

The dehydrator section of the tank or can is simply a bag of dessicant, such as molecular sieve, that is capable of absorbing and holding a small quantity of moisture.

A screen is placed in the dehydrator section to catch and hold any trash that may be in the system and prevent its circulation. Though this screen is not serviceable, the cleaned orifice tube that may be cleaned or replaced if necessary.

SUMMARY OF THE INVENTION

The accumulator dehydrator of the present invention provides for improved gas-liquid separation of the incoming stream of refrigerant, and is of a construction consisting predominantly of sheet metal stampings which are economical to produce and easy to assemble.

An important feature of the accumulator dehydrator is the provision of a deflector or baffle, made of sheet metal, and which is so assembled with other parts of the dehydrator as to remain permanently in operative position, in which position it enables the incoming liquid or vapor refrigerant to be deflected and directed to the bottom of the accumulator.

It is an object of the present invention to provide a accumulator dehydrator which exhibits improved separation of the gas and liquid components of the incoming refrigerant and which minimizes the amount of liquid refrigerant which enters the compressor.

Another object of the present invention is to provide a suction accumulator wherein the close proximity of the peripheral portion of a deflector interposed between the inlet and outlet is spaced slightly from the edge of the vessel, thus insuring that only gaseous refrigerant will flow to the center of the pick-up tube while the liquid refrigerant collects within the lower portion of the accumulator.

These and other objects and features of the invention will be apparent from the detailed description, together with the accompanying drawings.

DESCRIPTION OF THE PREFERRED EMBODIMENT

Figure 1:
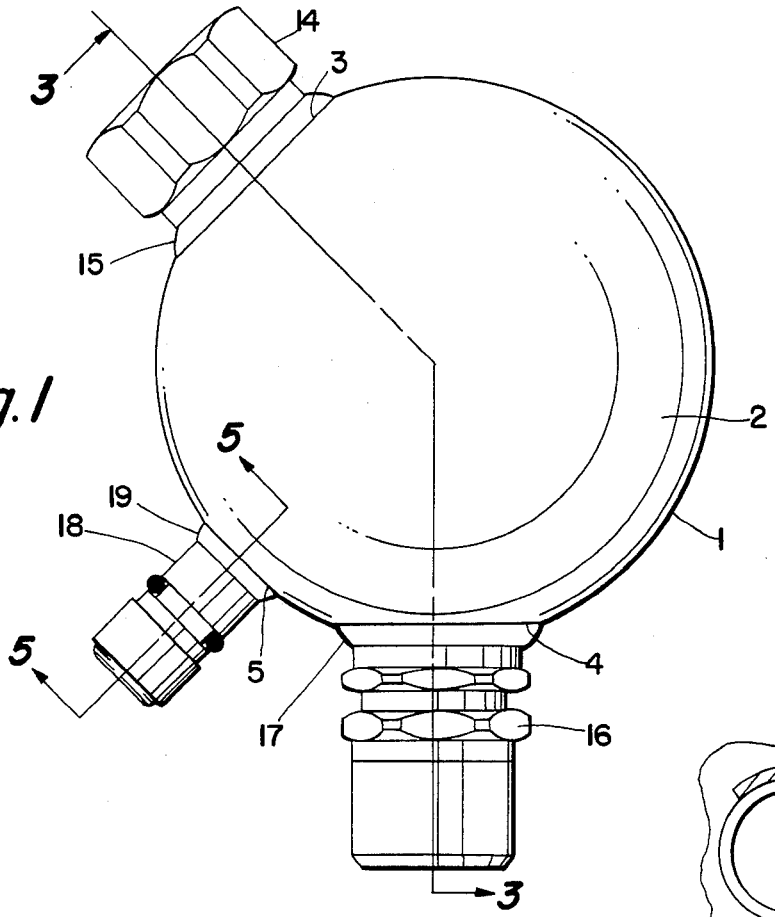
FIG. 1 is a top plan view of a preferred form of the accumulator dehydration, embodying the invention.

Referring more particularly to FIGS. 1 to 10 inclusive of the drawings, the accumulator dehydrator includes an accumulator cap 1, of generally cylindrical shape, having a dome-like upper end 2, and a series of circumferentially-spaced flats 3, 4 and 5 in the cylindrical wall of the cap. The cap is open at the bottom, as at 6.

The cylindrical side wall of the cap 1 is provided with openings 7, 8 and 9, the opening 7 extending through the flat 3, the opening 8 extending through the flat 4, and the opening 9 extending through the flat 5.

The accumulator dehydrator further includes a bottom cap 10, also of generally cylindrical shape, having a dome-like lower end 11, and open at its upper end, as at 12. The bottom cap 10 fits telescopically into the cap 1, and is welded to the cap 1, as at 13.

Figure 3:
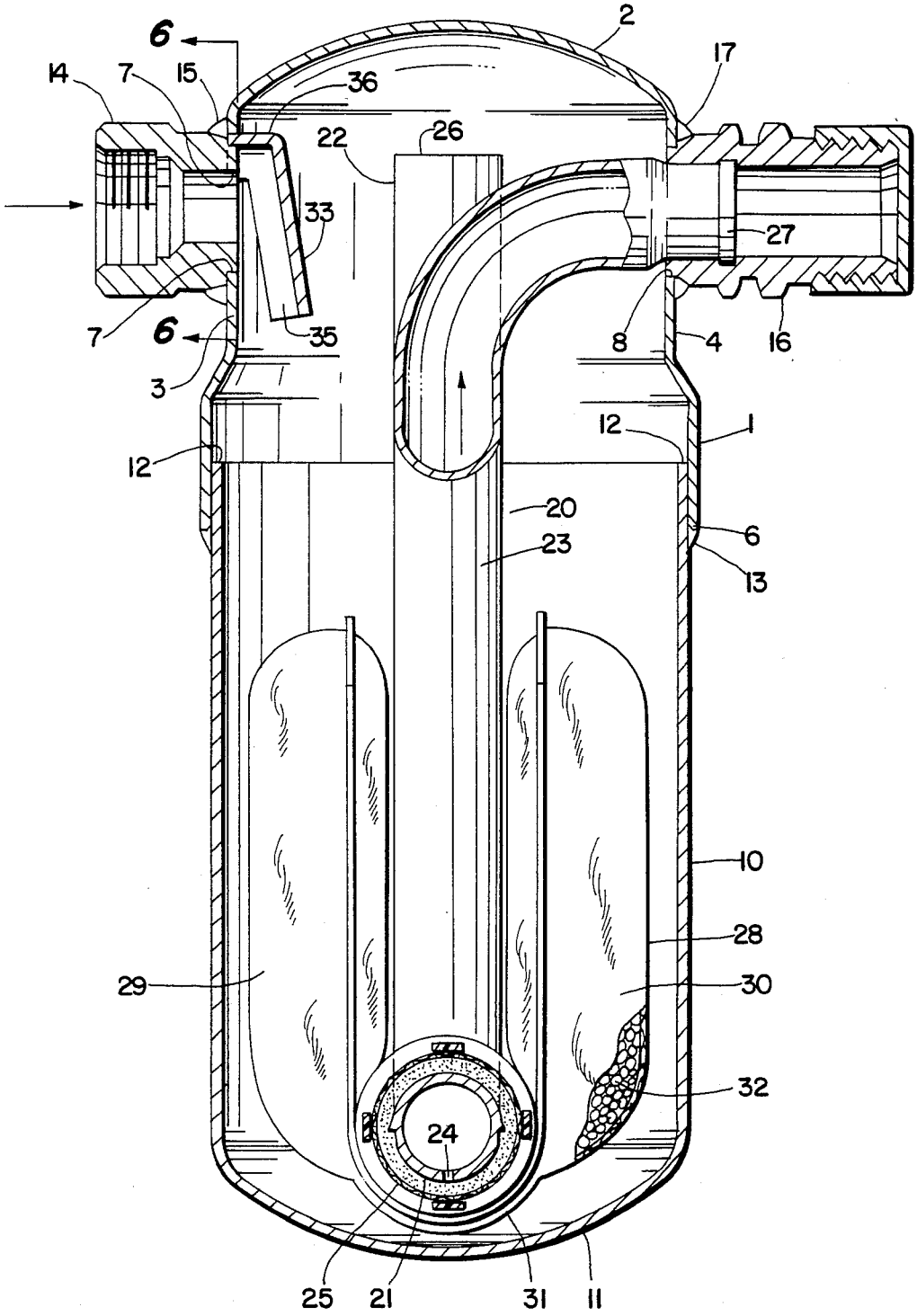
FIG. 3 is a cross-sectional view of the accumulator dehydrator taken on the line 3—3 of FIG. 1.
Figure 8:
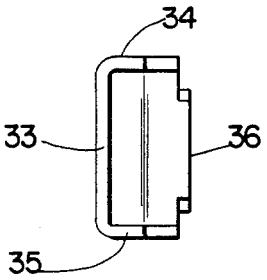
FIG. 8 is an end elevational view of the deflector of FIG. 7.
Figure 9:
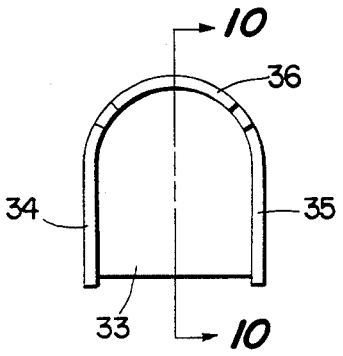
FIG. 9 is a plan view of the deflector of FIG. 7.

As shown in FIG. 3, there is secured to the cap 1, in axial alignment with the opening 7 in the flat 3, a hex-headed fitting 14, which is welded, as at 15, and has a portion thereof extending through the opening 7. The fitting 14 is an inlet fitting, which is adapted to receive fluid from the evaporator (not shown) of the automotive air-conditioning system, and to be discharged into the accumulator dehydrator.

Secured to the cap 1 in axial alignment with the opening 8 in the flat 4 is a fitting 16, which is welded, as at 17, to the flat 4, and has a portion thereof extending through the opening 8. The fitting 16 is an outlet fitting, which is adapted to receive fluid from the accumulator dehydrator to be delivered to the condenser (not shown) of the automotive air-conditioning system and returned to the evaporator.

Figure 4:
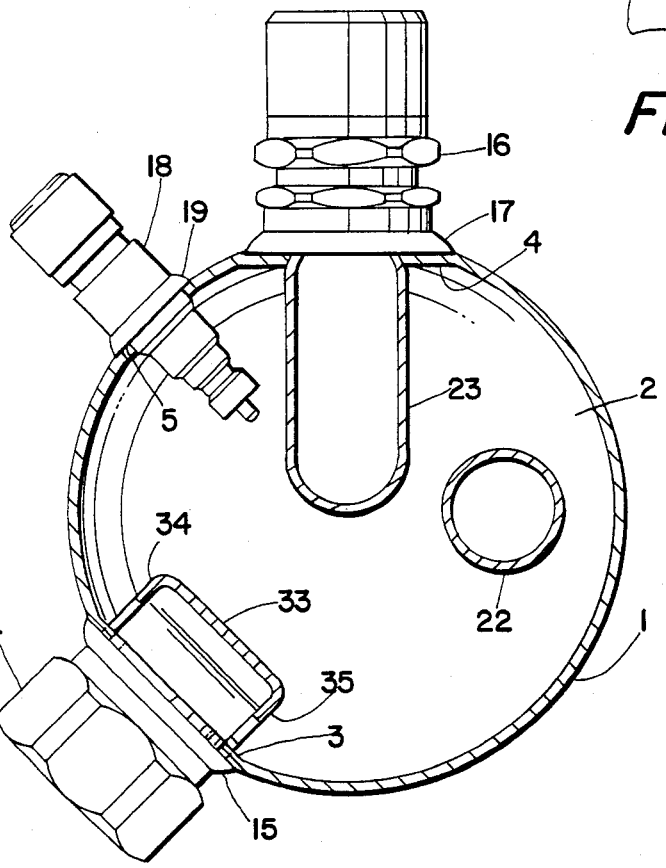
FIG. 4 is a cross-sectional view, taken on the line 4—4 of FIG. 2.
Figure 2:
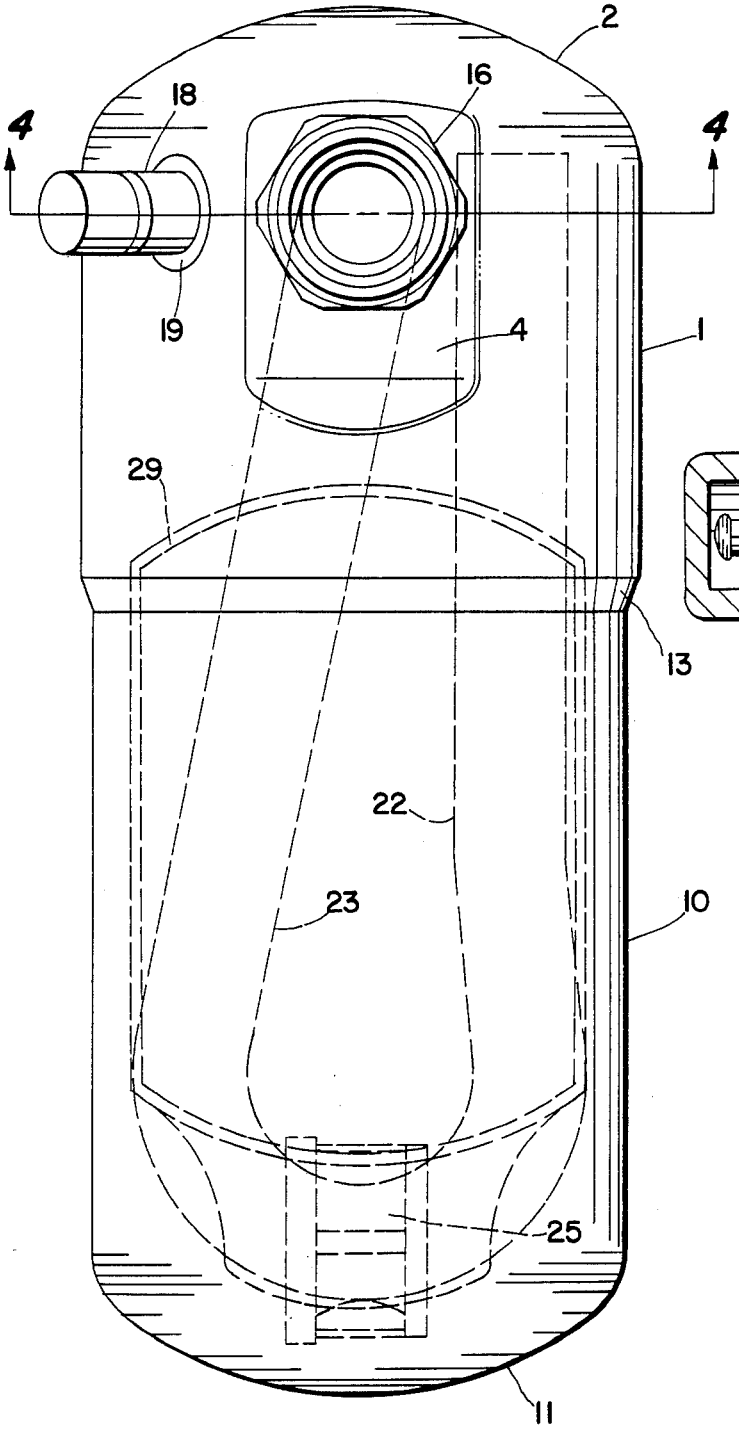
FIG. 2 is a side elevational view of the accumulator dehydrator, as viewed from the lower side of FIG. 1.
Figure 5:
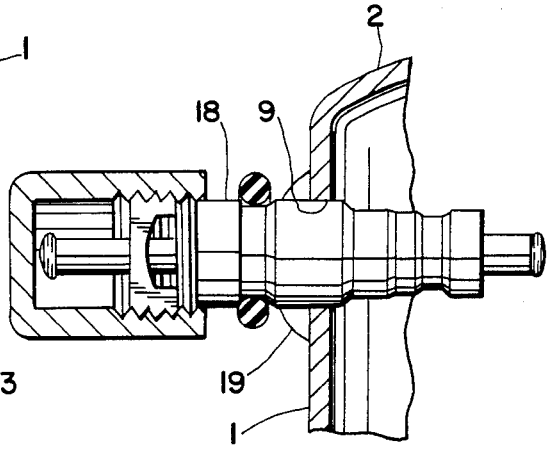
FIG. 5 is a fragmentary cross-sectional view, taken on the line 5—5 of FIG. 1.

Secured to the cap 1, in axial alignment with the opening 9 in the flat 5 see FIGS. 4 and 5, is a valve core 18 of the Schrader type, which is welded, as at 19, to the flat 5, and extends through the opening 9. The core 18 is part of a charge fitting or valve through which the system is charged with refrigerant.

The accumulator dehydrator is provided interiorly thereof with a U-shaped tube 20 comprising a bight portion 21 and a pair of upstanding leg portions 22 and 23. The bight portion 21, as shown in FIG. 3, has a bleed opening or port 24 through the bottom side thereof which is located adjacent to and faces the closed bottom 11 of the bottom cap 10, while the leg portions 22 and 23 are sized to extend substantially the height of the accumulator dehydrator. In addition, there is provided a cylindrical screen assembly 25 which is received about the bight portion 21 and serves to screen out particles in the collected liquid to prevent clogging of the bleed port 24.

The leg portion 22 has an open end 26 located adjacent the closed upper end of the cap 1. The other tube leg 23 has a right angle bend to its open end 27 which is adapted to be received in an permanently connected by swaging to the outlet fitting 16 thus providing for permanent attachment between the tube and the cap 1.

The accumulator dehydrator is further provided with a hollow porous dessicant container or molecular sieve 28, which is adapted to be received in the lower end of the accumulator dehydrator. The dessicant container is preferably made in the form of two bags or halves, 29 and 30, which as best seen in FIG. 3, are heat-sealed to each other, and are joined by a web 31, which partially encircles the screen 25. Each bag contains a dessicant 32, such for example, molecular sieve.

An important feature of the invention resides in the provision of a deflector for the accumulator dehydrator, which is of unique construction, and which can be assembled with the upper cap in a unique manner, without the aid of extraneous fasteners.

The deflector D is clearly illustrated in FIGS. 3, 4, 6, 7, 8, 9 and 10.

Figure 7:
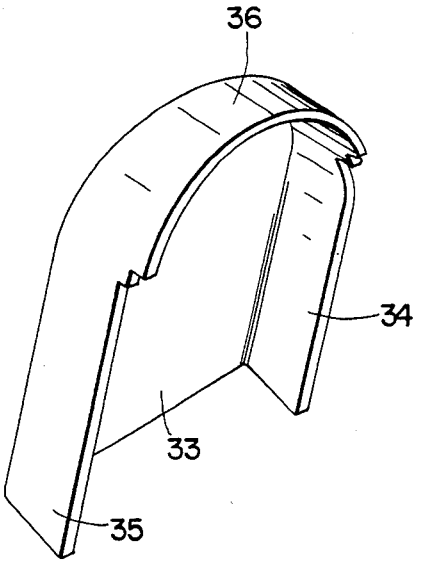
FIG. 7 is a perspective or isometric view of the deflector of the accumulator dehydrator.
Figure 10:
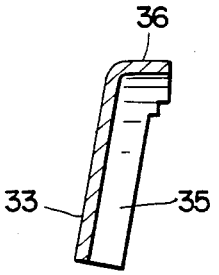
FIG. 10 is a cross-sectional view, taken on the line 10—10 of FIG. 9.

The deflector D is preferably made in one piece as a metal stamping, stamped or formed to provide a flat elongated body 33 having downturned flanges 34 and 35, at its side edges, and an arcuate flange 36 at one end. As seen in FIG. 7, the flange 36 extends inwardly beyond the edges of the flanges 34 and 35, to thereby form a tenon whereby the deflector D may be attached to the cap 1. Flange 36 has an arcuate extent of less than 360°.

Figure 6:
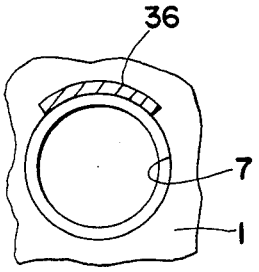
FIG. 6 is a fragmentary cross-sectional view, taken on the line 6—6 of FIG. 3.

In assembling the deflect D with the cap 1 and the fitting 14, the flange 36 is inserted between the surface of the cap 1 defining the hole 7 in the cap and the portion of the fitting 14 which extends into the hole 7. The engagement of these three parts acts not only to hold the deflector D in the position shown in FIG. 3, but also acts to prevent the deflector D from being rotated about the axis of the hole 7. FIGS. 3 and 6 show that opening 7 conforms in size and shape to the inserted portion of fitting 14 and flange 36. With the parts thus assembled, the weld material 15 is applied, and flows between the parts to permanently hold the fitting 14 and the deflector D in their operative position, as shown in FIGS. 3 and 4.

The incoming vaporous refrigerant is caused to impinge against the body 33 of the deflector D to encourage separation of the liquid components (refrigerant, oil, water) and cause same to be deposited in the bottom of the accumulator dehydrator.

With the dessicant (molecular sieve) stored in the dessicant bags, the deposited water is absorbed and retained thereby while the deposited liquid refrigerant and oil is eventually aspirated through the bleed port 24 in vaporous form into bight 21 of the tube 20, where it passes along with the vaporous refrigerant already flowing therethrough and then out the outlet fitting 16 into the compressor (not shown) of the air-conditioning system.

Figure 11:
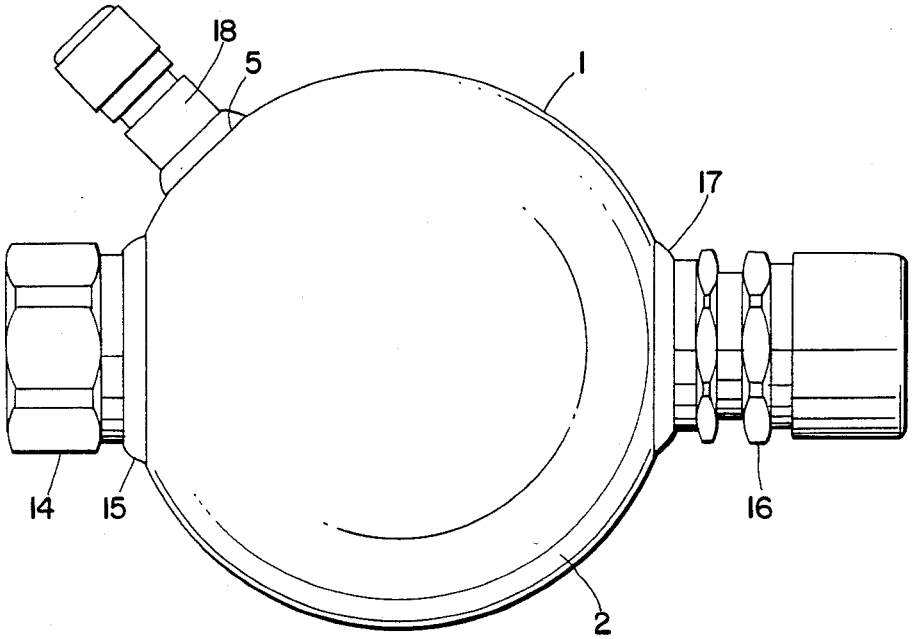
FIG. 11 is a view similar to FIG. 1, but showing that the deflector on the inlet port will operate regardless of the position of the outlet port.

In FIG. 11 of the drawings, a modification of the invention is shown, in which the inlet and outlet fittings are disposed at diametrically-opposite sides of the cap. This accumulator dehydrator is basically the same on the inside and bottom half as that therein above described, the only difference being the location of the inlet and outlet fittings to fit different models of General Motors cars. The fittings on the accumulator dehydrators are located depending on how the accumulator is mounted on the car and the bend configuration of the tube and hose assembly that is secured to the accumulator. The accumulator serves the same purpose irrespective of the model car or the fitting location.

While this invention has been described as having a preferred construction, it will be understood that it is capable of further modification. This application is, therefore, intended to cover any variations, uses, or adaptations of the invention following the general principles thereof and including such departures from the present disclosure as come within known or customary practice in the art of which this invention pertains, as may be applied to the essential features hereinbefore set forth and fall within the limits of the appended claims.

I claim:

1. An accumulator dehydrator comprising:

a casing having an inlet opening and an outlet opening, a dessicant container in said casing, deflector means in said casing having a body in close proximity to said inlet opening for engagement by refrigerant entering said casing through said inlet opening, said deflector means comprising an arcuate flange, an inlet fitting having a portion extending into said inlet opening, said arcuate flange extending into said opening, and means for securing said portion of said fitting and said arcuate flange in said opening in said casing.

2. The accumulator dehydrator of claim 1, said last mentioned means comprising weld material.

3. The accumulator dehydrator of claim 1, said arcuate flange engaging and being clamped between the exterior of said fitting portion and the casing surface defining said opening.

4. The accumulator dehydrator of claim 1, said opening having a shape and size to conform to said fitting portion and flange extending thereinto.

5. The accumulator dehydrator of claim 4, said arcuate flange having an arcuate extent of less than 360°.

6. The accumulator dehydrator of claim 1, said deflector body having flanges extending from the edges thereof.

* * * * *